US007980550B2

(12) United States Patent
Chou et al.

(10) Patent No.: US 7,980,550 B2
(45) Date of Patent: Jul. 19, 2011

(54) PAPER OUTPUT MECHANISM FOR PAPER FEEDING APPARATUS

(75) Inventors: Ken-Te Chou, Taoyuan (TW); Yu-Jen Chang, Taoyuan (TW)

(73) Assignee: Teco Image System Co., Ltd, Taipei (TW)

( * ) Notice: Subject to any disclaimer, the term of this patent is extended or adjusted under 35 U.S.C. 154(b) by 23 days.

(21) Appl. No.: 12/510,697

(22) Filed: Jul. 28, 2009

(65) Prior Publication Data

US 2010/0314826 A1 Dec. 16, 2010

(30) Foreign Application Priority Data

Jun. 12, 2009 (CN) ..... 98 1 19846

(51) Int. Cl.
*B65H 3/52* (2006.01)

(52) U.S. Cl. ..... 271/121

(58) Field of Classification Search ..... 271/121, 271/122, 125
See application file for complete search history.

(56) References Cited

U.S. PATENT DOCUMENTS 5,435,538 A * 7/1995 Billings et al. ..... 271/34

FOREIGN PATENT DOCUMENTS

JP 03128835 A * 5/1991

* cited by examiner

*Primary Examiner* — Michael McCullough
(74) *Attorney, Agent, or Firm* — Rabin & Berdo, P.C.

(57) ABSTRACT

A paper output mechanism for an automatic document feeder, including: a seat; a connecting shaft, passed through the seat; and a paper feeding roller, placed around the connecting shaft, and including: a shaft portion; a roller portion, placed around the shaft portion; and adapted to convey a document, and an elastic element, placed around the shaft portion, and one end thereof being connected to the seat.

9 Claims, 6 Drawing Sheets

PAPER OUTPUT MECHANISM FOR PAPER FEEDING APPARATUS

CROSS-REFERENCES TO RELATED APPLICATIONS

This non-provisional application claims priority under 35 U.S.C. §119(a) on Patent Application No(s). 98119846 filed in Taiwan, R.O.C. on Jun. 12, 2009, the entire contents of which are hereby incorporated by reference.

TECHNICAL FIELD

The present invention relates to a paper output mechanism, and more particularly to a paper output mechanism for an automatic document feeder (ADF).

BACKGROUND

Accompanying the progress of technology, business machines corresponding to computer peripherals such as printers, scanners, facsimile machines can help increase the efficiency by which information is processed, which has made them increasingly popular. Furthermore, accompanying the technological development of one machine with multiple function, more and more business machines have multiple functions such as facsimile, scanning, photo-offset and printing; not only ensuring that the business machines have the ability to process multiple documents, but also allowing their volume to be reduced. In addition, the assembly procedures thereof are simple (involving connecting them with a telephone line, a network cable and power cord), and they can also be used in coordination with a computer, which has contributed to their popularity.

A comprehensive survey of business machines such as printers, photocopiers, scanners and facsimile machines, demonstrates that they all can be installed with an automatic document feeder (ADF) capable of feeding paper one page at a time. Please refer to FIG. 1, which illustrates a conventional paper output structure for an automatic document feeder, at least constituted by a paper feeding roller A1, rotating shaft A2, copper sleeve A3, spring A4, cover A5 and mounting bracket A6, where the paper feeding roller A1 is placed around the rotating shaft A2, the copper sleeve A3 is installed on the side of the paper feeding roller A1, the spring A4 is placed around the copper sleeve A3, and the assembly of the paper output structure is finally completed by installing a work piece made from the aforementioned assembly steps in the mounting bracket A6 after the cover A5 is covered on the spring A4.

However, components of the conventional paper output structure for an automatic document feeder are complicated; not only is the cost of individually manufactured components manufactured higher, but a tolerance between each two components must be considered while they are being assembled. In addition, the assembly's operation is difficult and tedious.

SUMMARY

To improve a paper output structure for an automatic document feeder, reduce the number of components thereof, and ensure that the component and assembly costs of the paper output structure are reduced, the present invention is proposed.

A paper output mechanism for an automatic document feeder proposed by the present invention includes: a seat; a connecting shaft, passed through the seat; and a paper feeding roller, placed around the connecting shaft and including: a shaft portion: a roller portion, placed around the shaft portion and adapted to convey documents; and an elastic element, placed around the shaft portion, one end thereof being connected with the seat.

The present invention also proposes a paper output mechanism for an automatic document feeder, including: a seat; and a paper feeding roller, engaged with the seat and including: a connecting shaft, passed through the seat and including a shaft portion; a roller portion, placed around the shaft portion and adapted to convey documents; and an elastic element, placed around the shaft portion and one end thereof being connected with the seat.

The seat includes a positioning hole, and one end of the elastic element is engaged with the positioning hole to position the elastic element and the seat.

Furthermore, the shaft portion includes a first shaft and a second shaft connected to each other, where the roller portion is placed around the first shaft and the elastic element is placed around the second shaft. Moreover, one end of the elastic element is propped against the first shaft. In addition, the outer diameter of the first shaft is greater than the outer diameter of the second shaft.

The present invention places the paper feeding roller around the connecting shaft or integrates the paper feeding roller with the connecting shaft into one body. One end of the elastic element is then positioned directly on the paper feeding roller, and another end thereof is connected directly to the seat. When compared with the conventional paper output structure, not only is the structure of the present invention very simple, but both the product cost of the components and the assembly cost can also be reduced substantially.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
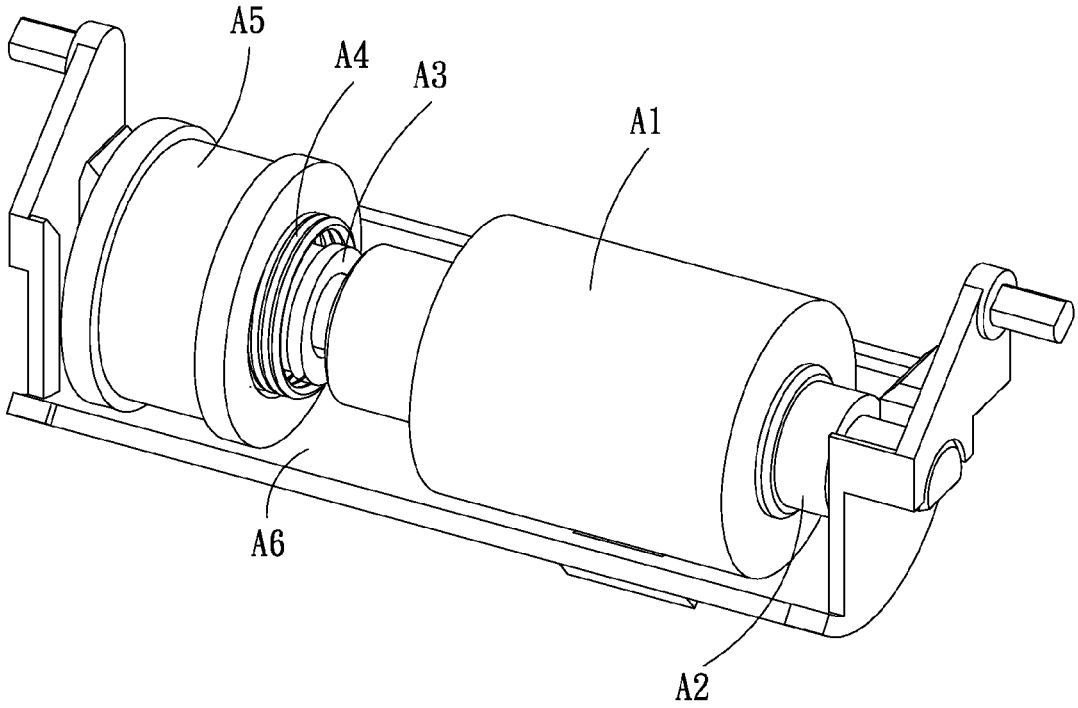
FIG. 1 (Prior art)
FIG. 1 is a schematic view of a conventional paper out structure.
Figure 2:
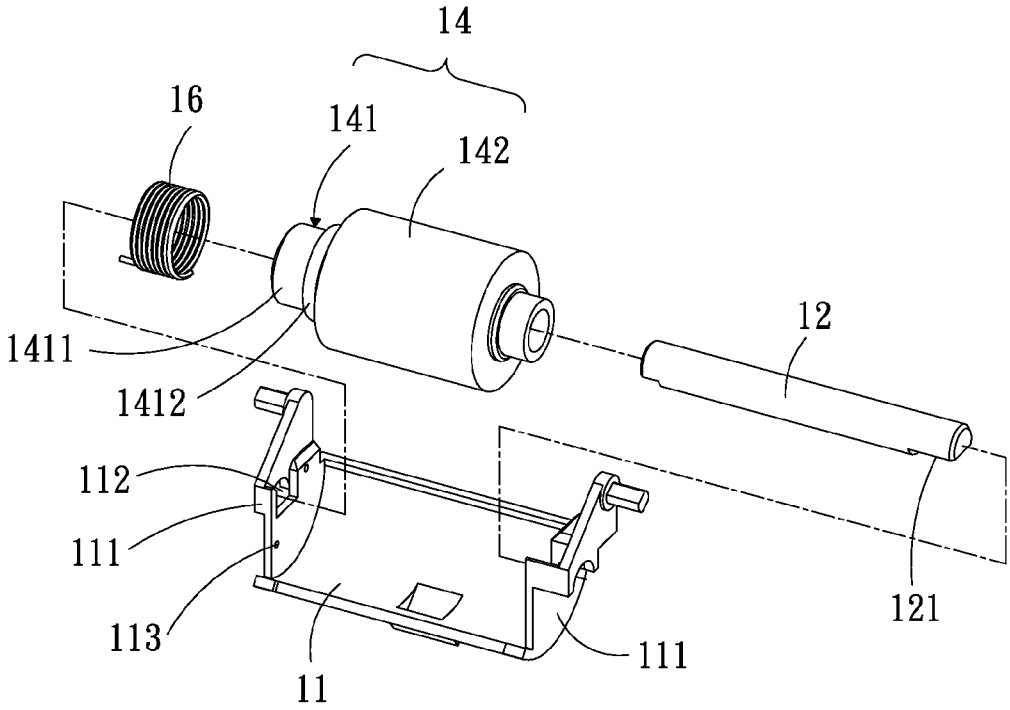
FIG. 2 is an exploded view of a first preferred embodiment according to the present invention.
Figure 3:
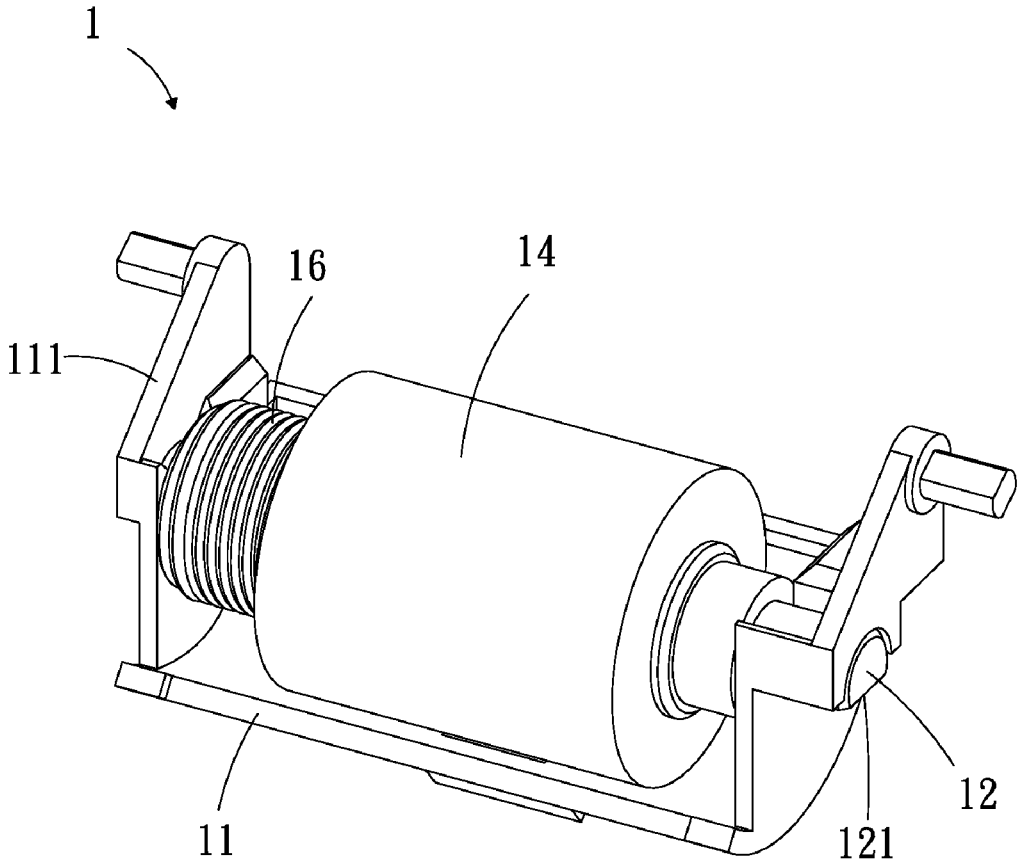
FIG. 3 is a schematically perspective view of the first embodiment according to the present invention.

Please refer to FIG. 2 and FIG. 3. FIG. 2 and FIG. 3 show a paper output mechanism for an automatic document feeder of a preferred embodiment according to the present invention.

A paper output mechanism 1 for an automatic document feeder includes a seat 11, a connecting shaft 12, a paper feeding roller 14 and an elastic element 16.

The seat 11 is approximately a hollow accepting body, the bottom thereof is a curved plate, the two sides thereof are respectively extended with a side wall face 111, and an accepting hole 112 is disposed on each side wall face 111 and a positioning hole 113 is disposed on one of the two side wall faces 111.

The connecting shaft 12 is approximately a long-strip-shaped rod, the two ends thereof are respectively passed through the accepting holes 112 of the seat 11, where an chamfer cut 121 may preferably be disposed on the connecting shaft 12 in the longitudinal direction thereof, the cross sectional face of the connecting shaft 12 is approximately semicircular from side viewing. Furthermore, the chamfer cut 121 of the connecting shaft 12 is engaged with the wall face of the accepting hole 112, allowing the connecting shaft 12 to be accepted in the accepting hole 112 and be impossible to be rotated. However, the aforementioned structure of the connecting shaft 12 is only an example and it is not limited to this, according to the present invention.

The paper feeding roller 14 is placed around the connecting shaft 12. In the present embodiment, the paper feeding roller 14 mainly constitutes a shaft portion 141 and roller portion 142, where the roller portion 142 may be made from a rubber material or plastic material, placed around the shaft portion 141 and adapted to convey documents 8. In addition, the shaft portion 141 is preferably constituted by a first shaft 1411 and a second shaft 1412 connected to each other, where the roller portion 142 is placed around the first shaft 1411, and the outer diameter of the first shaft 1411 is preferably greater than the outer diameter of the second shaft 1412. However, the aforementioned structure of the paper feeding roller 14 is only an example and it is not limited to this, according to the present invention.

The elastic element 16 is placed around the shaft portion 141 of the paper feeding roller 14, and one end thereof is engaged with the positioning hole 113 of the seat 11 to position the elastic element 16 and the seat 11, where the elastic element 16 may preferably be placed around the second shaft 1412 of the shaft portion 141, and another end of the elastic element 16 not engaged with the positioning hole 113 is propped against the first shaft 1411.

Figure 4:
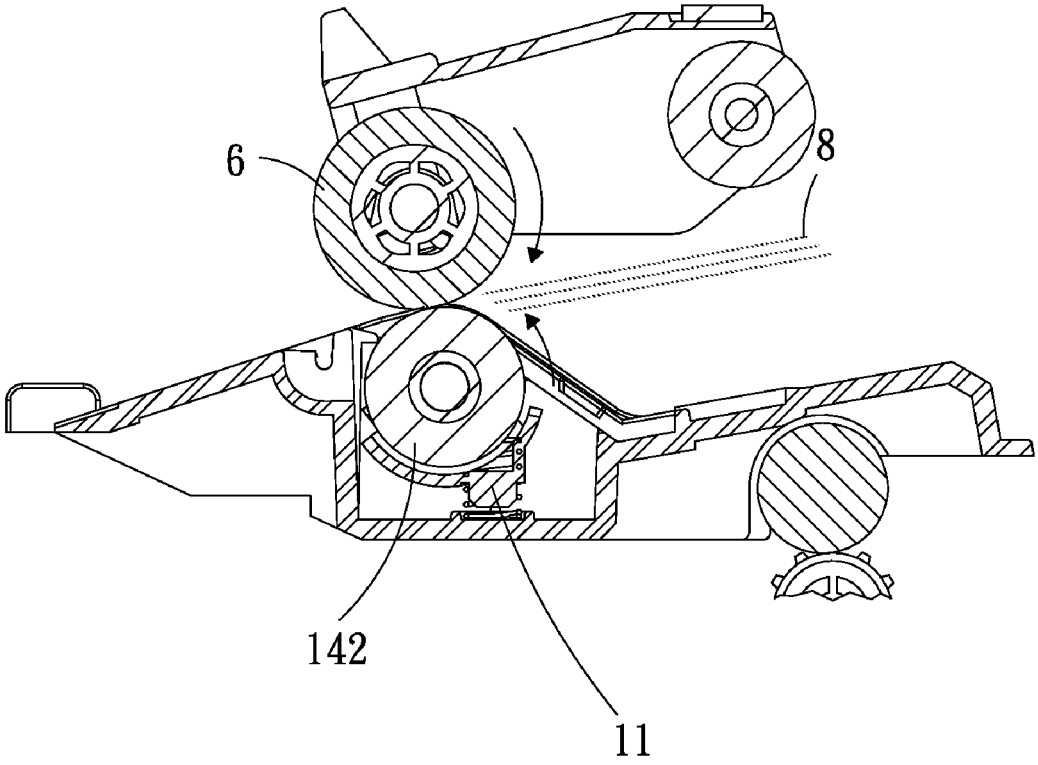
FIG. 4 is cross sectional view of the first embodiment according to the present invention while a document is being output.

Please refer to FIG. 4. The paper feeding roller would be rotated with a transmission wheel 6 if no document 8 is passed when the transmission wheel 6 is rotated; only the transmission wheel 6 would drive the document 8 to move forward due to a greater friction force of the transmission wheel 6 when the document 8 is passed. The transmission wheel 6 would drive only the uppermost document 8 to move forward and the other documents would be blocked by the paper feeding roller 14 and prevented from moving if more than one document 8 are passed.

In the present embodiment, the paper feeding roller 14 is placed around the connecting shaft 12, and one end of the elastic element 16 is positioned directly on the paper feeding roller 14 together with another end thereof is connected directly to the seat 11 so that the number thereof is less than the number of the conventional paper output structure, and the production cost and assembly costs can be effectively decreased.

Figure 5:
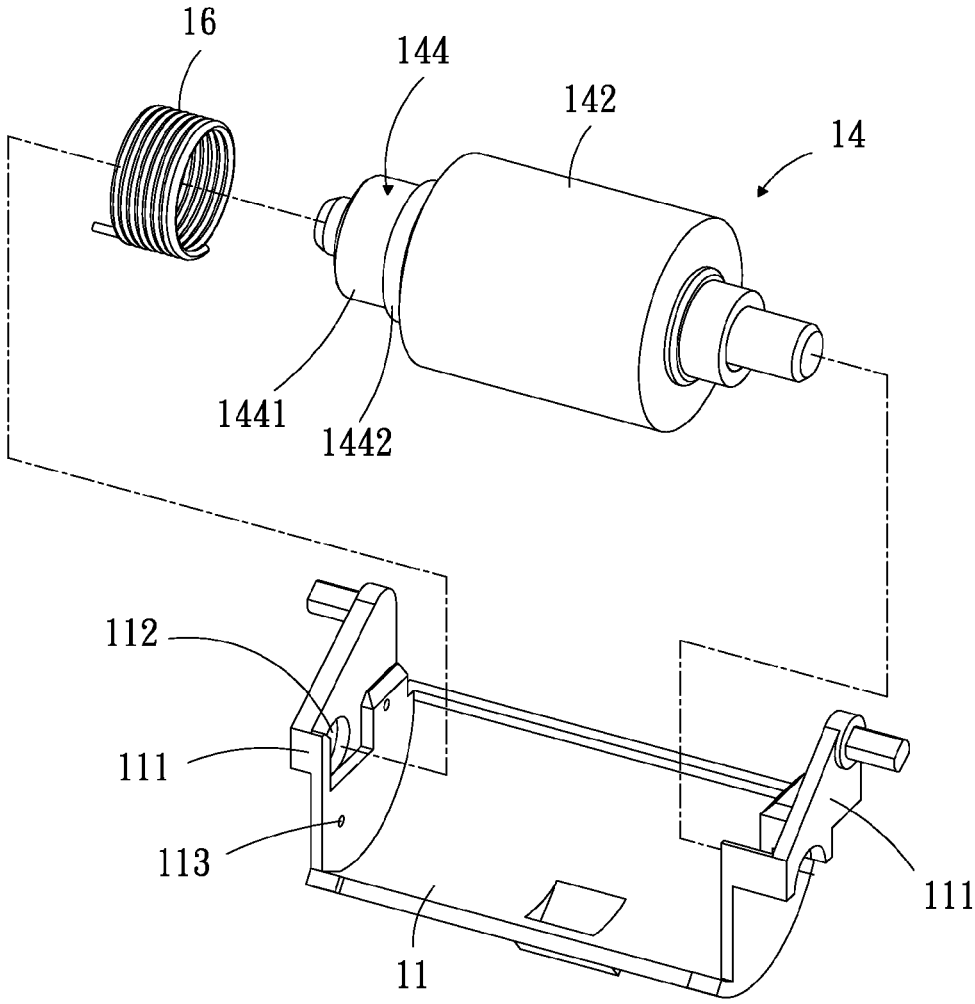
FIG. 5 is a schematically exploded view of a second preferred embodiment according to the present invention.
Figure 6:
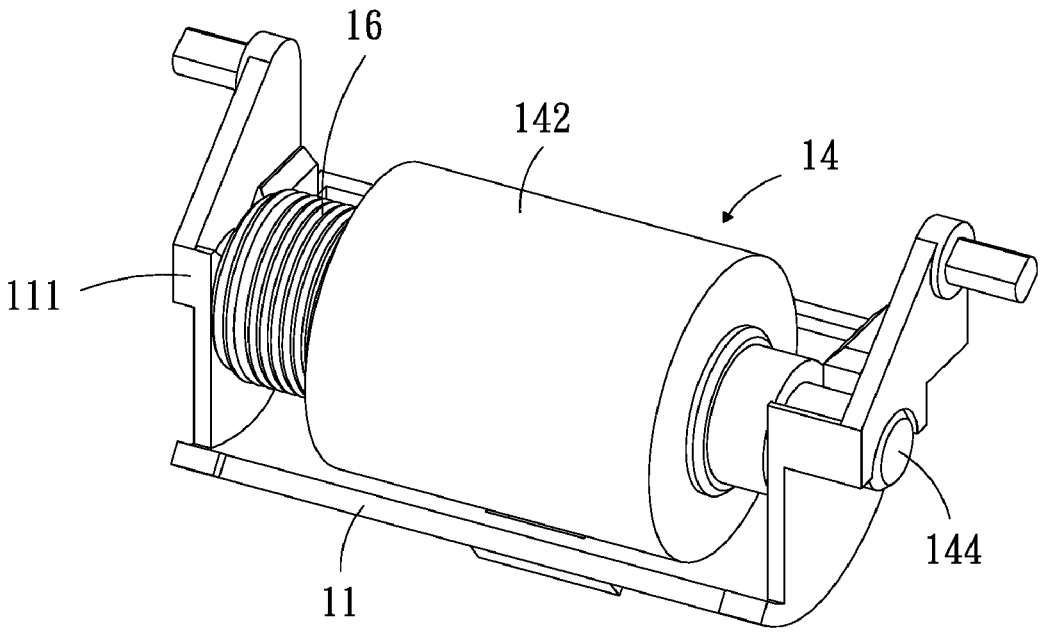
FIG. 6 is a schematically prospective view of the second embodiment according to the present invention.

Please refer to FIGS. 5 and 6, FIGS. 5 and 6 illustrates a paper feeding mechanism for an automatic document feeder of a second preferred embodiment according to the present invention. The difference between the present invention and the first embodiment is the structure of the paper feeding roller 14. In the present embodiment, the paper feeding roller 14 mainly constitutes a connecting shaft 144 and a roller portion 142, where the connecting shaft 144 is a long-strip-shaped rod, the cross sectional face of the connecting shaft 144 is approximately semicircular from side viewing, and the two ends of the connecting shaft 144 are respectively accepted in the accepting holes 112 of the seat 11. Furthermore, the connecting shaft 144 has a shaft portion constituted by a first shaft 1441 and a second shaft 1442 connected to each other, where the roller portion 142 is placed around the second shaft 1442, and one end of the elastic element 16 is engaged with the positioning hole 113 and another end thereof is propped against the first shaft 1441, where the outer diameter of the first shaft 1441 may preferably be greater than the outer diameter of the second shaft 1442.

The greatest difference between the present embodiment and the first embodiment is that the connecting shaft and the paper feeding roller of the first embodiment respectively are two independent components, but the connecting shaft and the paper feeding roller of the present embodiment are integrated to form one single component such that the number of the components thereof is less than that of the first embodiment. In addition, the connecting shaft of the first embodiment has a chamfer cut so that the chamfer cut of the connecting shaft is engaged with the wall face of the accepting hole, ensuring that the connecting shaft is not rotated while the paper feeding roller is rotated; the paper feeding roller of the present embodiment is configured with the structure of the connecting shaft so that the connecting shaft structure thereof will be rotated with the roller portion of the paper feeding roller.

The present invention may place the paper feeding roller around the connecting shaft, or integrate the paper feeding roller with the connecting shaft into one body. In addition, the elastic element is placed around the paper feeding roller, and one end thereof is positioned directly on the paper feeding roller and another end thereof is connected directly to the seat. In contrast with the conventional paper output structure, the present invention need not be configured with components such as a copper sleeve and cover. Accordingly, the structure of the present invention is simpler than the conventional paper output structure, and the number of the components thereof is also less than that of the conventional structure, resulting in substantial reduction of component production cost and the assembly cost of the paper output mechanism. Furthermore an assembly flow can simplified, and reducing the number of components can also effectively increase the efficiency and the yield of an assembly operation.

While the present invention has been described by the way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A paper output mechanism for an automatic document feeder, comprising:

a seat;

a connecting shaft, passed through the seat; and a paper feeding roller, placed around the connecting shaft, and comprising:

a roller portion, a shaft portion, comprising a first shaft and a second shaft connected to the first shaft and protruding from a side face of the first shaft, wherein a length of the first shaft is longer than a length of the roller portion, and the roller portion is placed around the first shaft, and an elastic element, placed around the second shaft and located outside of the first shaft, and one end thereof being connected to the seat, and the other end propped against the first shaft.

2. The paper output mechanism for the automatic document feeder according to claim 1, wherein the seat comprises a positioning hole, and one end of the elastic element is engaged with the positioning hole to position the elastic element and the seat.

3. The paper output mechanism for the automatic document feeder according to claim 1, wherein the seat comprises an accepting hole, adapted to accept the connecting shaft.

4. The paper output mechanism for the automatic document feeder according to claim 3, wherein the connecting shaft comprises a chamfer cut, adapted to engage with a wall face of the accepting hole.

5. The paper output mechanism for the automatic document feeder according to claim 1, wherein an outer diameter of the first shaft is greater than an outer diameter of the second shaft.

6. A paper output mechanism for an automatic document feeder, comprising:

a seat; and a paper feeding roller, engaged with the seat, and comprising:

a roller portion;

a connecting shaft, passed through the seat, comprising a first shaft and a second shaft connected to the first shaft and protruding from a side face of the first shaft, wherein a length of the first shaft is longer than a length of the roller portion, and the roller portion is placed around the first shaft; and an elastic element, placed around the second shaft and located outside the first shaft, and one end thereof being connected to the seat, and the other end propped against the first shaft.

7. The paper output mechanism for the automatic document feeder according to claim 6, wherein the seat comprises a positioning hole, and one end of the elastic element is engaged with the positioning hole to position the elastic element and the seat.

8. The paper output mechanism for the automatic document feeder according to claim 6, wherein the seat comprises an accepting hole, adapted to accept the connecting shaft.

9. The paper output mechanism for an automatic document feeder according to claim 6, wherein an outer diameter of the first shaft is greater than an outer diameter of the second shaft.

* * * * *